US005081339A

United States Patent [19]

Stine

[11] Patent Number: 5,081,339

[45] Date of Patent: Jan. 14, 1992

[54] WATER BED HEATER

[75] Inventor: Clifford R. Stine, Laurel, Miss.

[73] Assignee: Sunbeam Corporation, Pittsburgh, Pa.

[21] Appl. No.: 531,813

[22] Filed: Jun. 1, 1990

[51] Int. Cl.[5] ..... H05B 3/36

[52] U.S. Cl. ..... 219/217; 219/528; 219/504; 219/549

[58] Field of Search ..... 219/217, 212, 504, 505, 219/528, 529, 549

[56] References Cited

U.S. PATENT DOCUMENTS

| | | | |
|---|---|---|---|
| 3,114,825 | 12/1963 | Kilburn | 219/528 |
| 3,790,753 | 2/1974 | Miller | 219/528 |
| 3,808,403 | 4/1974 | Kanaya | 219/528 |
| 4,220,848 | 9/1980 | McMullan | 219/528 |
| 4,242,573 | 12/1980 | Batliwalla | 219/528 |
| 4,314,230 | 2/1982 | Cardinal et al. | 338/314 |
| 4,314,231 | 2/1982 | Walty | 338/328 |
| 4,425,497 | 1/1984 | Leary et al. | 219/544 |
| 4,547,659 | 10/1985 | Leary et al. | 219/544 |
| 4,652,726 | 3/1987 | Femino | 219/217 |
| 4,719,335 | 1/1988 | Batliwalla et al. | 219/528 |
| 4,761,541 | 8/1988 | Batliwalla et al. | 219/528 |
| 4,774,397 | 9/1988 | Grise | 219/549 |
| 4,798,936 | 1/1989 | Johnson | 219/217 |
| 4,967,057 | 10/1990 | Bayless | 219/217 |

FOREIGN PATENT DOCUMENTS

| | | | |
|---|---|---|---|
| 2168580 | 6/1986 | United Kingdom | 219/212 |

*Primary Examiner*—Teresa J. Walberg

*Attorney, Agent, or Firm*—Arnold B. Silverman; Neil M. Rose

[57] ABSTRACT

A heater for a water bed including an elongated PTC cable having conductors by a carbon loaded polymer material with the cable being tortuously disposed with closely spaced parallel lengths supported in a coplanar sandwiched relationship by adhesively coated sheets of polyester and aluminum, the sheets and cable being sealed in a polyvinyl chloride envelope.

6 Claims, 4 Drawing Sheets

WATER BED HEATER

FIELD OF THE INVENTION

This invention relates to a heater for use beneath the water containing mattress of a water bed and the method of making such heater.

BACKGROUND OF THE INVENTION

As water beds have gained in popularity, many improvements have been made to overcome disadvantages that were present in the early primitive versions. A water bed consists of a rigid box-like, open top, frame which supports a generally flat envelope enclosing a volume of water. There are normally partitions or separations in the water containing envelope or mattress to prevent the water from shifting around excessively under the body of the user. One of the important features of a water bed is the means to heat the contents of the mattress to a temperature substantially above room temperature. Accordingly, it is desirable to provide an electric heater which has the capacity to heat the liquid contents of the mattress to a temperature of approximately 85° Fahrenheit (29.4° Centigrade).

The heater for the mattress is typically positioned on the upwardly facing surface of the mattress supporting frame with the mattress laying directly on top of the heater. It has been found that a normal water bed requires a heater having the capacity to deliver 300 or 400 watts in order to maintain the water at the desired 85° F. temperature. There are some unusual requirements placed on the heater because of the environment in which it is located and the nature of the heat exchange and control problems encountered.

Although precise temperature control of the water in the mattress is not necessary, there are problems in controlling the heater which must heat the temperature of a large mass of water. The typical prior art water bed heater included a resistance heater similar to that which might be used in a heating pad but enclosed in a watertight envelope and controlled by a temperature probe located at a position spaced from the heating element and lying against the bottom of the mattress. Because of the thermal lag between the heater and the control, the heater would cycle over long time periods and had to be designed to operate on such long cycles without creating overheat problems.

Many types of heaters, if left on continuously, will have a tendency to create local overheating problems in the vicinity of the heater while the mass of the water in the mattress is still far below the desired temperature. This problem suggests that the heater must be somewhat distributed and not deliver the heat to too restricted a location or the material of the mattress would be damaged. There is no necessity that the heater be distributed entirely across the lower face of the mattress. The compromise as to the surface area of the heater engaged with the lower face of the mattress is largely a question of the materials used and the character of the heater.

There have been many serious problems involving the currently available resistance type water bed heaters having safety thermostats to guard against overheat conditions. The problem with such thermostats is that they cannot be made to respond to overheat conditions that may occur any place over the entire area of the heater. Accordingly, if the overheat occurs at a point away from the safety thermostat, damage may occur to the mattress or heater as a consequence of the overheat. To understand the nature of the problem, we need only look at the many possible causes of such overheat conditions.

If the user or installer of the water bed folds the heater or places some article of clothing between the heater and the mattress, an overheat will occur which may or may not be sensed by the safety thermostat before damage occurs. If the mattress is incompletely filled or used by someone who is very heavy, "bottoming out" takes place. This is a condition in which the user of the bed has his knee or posterior lying directly against the heater only separated by the top and bottom layers of the mattress envelope but with no water therebetween. This situation causes overheating and destruction of the mattress if the thermostat fails to respond.

It is also noted that it is important to have good heat exchange characteristics between the heater and the water contained in the mattress again to avoid local overheating in the area of the heater.

Another problem relating to the environment in which the water bed heater is placed relates to the risk of the mattress developing a leak and water being deposited in the area in which the heater is located. It is desirable, therefore, that any electrical heater located in such an environment be sealed and grounded to avoid the risk of delivering an electrical shock to the user of the bed.

As indicated above, some prior art water bed heaters have utilized conventional resistance type heating elements sealed in an envelope somewhat like the structure of a heating pad. There have also been attempts at fabricating water bed heaters of sheets of positive temperature coefficient (PTC) materials which have had patterns of electrodes deposited on one side thereof across the entire face of the sheet so that the sheet itself acts as a heater. Heaters of this general type are disclosed in the patents to Battiwalla, et al. No. 4,761,541 and No. 4,719,335 and to Grise No. 4,774,397. Other attempts have been made at depositing strips of PTC material between polyester sheets with spaced electrodes to supply current to the strips. Tests by applicant of these various types of water bed heaters made using sheets or layers of PTC material have indicated many shortcomings in these heaters. At the present time there are no practical or commercially successful water bed heaters on the market using PTC. Some tended to have low breakdown temperatures, and others exhibited negative temperature coefficient characteristics when heated for prolonged periods of time. The studies made of the commercially available water bed heaters indicated that there existed a need for a reliable and safe water bed heater which would operate in a foolproof manner to maintain the water in the mattress at approximately 85° F. while eliminating any risks of shock to the user in the event of water leakage from the mattress.

Other prior art patents of interest are the patents to Leary, et al. No. 4,425,497 and No. 4,547,659 which disclose PTC heaters sandwiched between aluminum sheets to increase power output. Also of interest is the patent to Waltz No. 4,314,231 which discloses a PTC heater with mesh electrodes enclosed in an envelope of polymeric insulating layers.

Of increasing concern in recent years is the possibility that the electromagnetic fields associated with current carrying wires may in some way be injurious to the health of a human exposed to such fields. This concern is somewhat greater with respect to appliances or products where the exposure is greater and continues over a longer period of time as with electric heaters associated with water beds. There have been no prior art water bed heaters which address the problem of electromagnetic radiation or have included any means to reduce such radiation.

BRIEF SUMMARY OF THE INVENTION

The present invention involves a water bed heater and the method of making such heater which utilizes an elongated cable consisting of spaced conductors separated by positive temperature coefficient material. The PTC material may preferably comprise a carbon loaded polymer of the type disclosed and claimed in Kelly U.S. Pat. No. 4,277,673. In the preferred form of the heater, the cable is held in a tortuous configuration consisting of elongated, parallel, coplanar, closely spaced legs interconnected to form a rectangular sheet heater. The cable is supported in the above described configuration and maintained in a substantially flat shape by layers of polyester and aluminum coated with an adhesive which engage opposite sides of the cable sandwiched between the sheets of polyester and aluminum. This sandwich is then enclosed in a sealed polyvinyl chloride (PVC) envelope which may then be laid beneath the mattress of a water bed.

The resulting assembly has good heat transfer characteristics by virtue of the positioning of the conductors by the adhesive coated sheets and the evacuation of air from the sealed PVC envelope to reduce any convection effects and assure intimate engagement of the cable with the sheets, the PVC envelope and the water bed mattress.

The PTC cable is made with a carbon loaded polymer material having positive resistance temperature characteristics so that it self-limits and effectively becomes non-conducting at about 130°C. The self-limiting characteristic of the cable exists over the entire length of the cable, so there is no chance of overheating resulting in any uncontrolled portion of the heater.

The use of the PTC cable with its self-limiting temperature characteristics permits the complete elimination of any safety thermostat associated with the heater itself. The self-limiting nature of each segment of the entire heating cable eliminates the risk with present heaters that the overheat may not be close enough to a safety thermostat to shut down the circuit before damage takes place. With my PTC cable the wattage generated only in the area of the overheat will be reduced while the remainder of the heating cable may function normally, providing a safer and more effective heater.

The PTC cable is connected to a source of power at one end so that the spaced conductors carry current which is 180° out of phase with each other. Thus, the electromagnetic fields associated with each conductor in a cross section of the cable are essentially equal and opposite, thereby cancelling each other out. As a result, there is almost no measurable electromagnetic field associated with the heater of the present invention.

It is an object of the present invention to provide an improved water bed heater including an elongated PTC cable enclosed in a sealed envelope for insertion on the underside of a water bed mattress.

It is a further object of the present invention to provide an improved water bed heater utilizing an elongated PTC cable which is arranged in a compact configuration and supported between a pair of thin sheets forming a flat sandwich.

It is another object of the present invention to provide an improved water bed heater having substantially eliminated electromagnetic radiation through arrangement of current carrying conductors to cancel out the electromagnetic fields associated with such conductors.

It is another object of the present invention to provide a simplified water bed heater using a self-limiting PTC heating material, thereby eliminating the need for any safety thermostats associated with the heater.

It is another object of the present invention to provide an improved method of making a water bed heater of the type utilizing a self-limiting PTC heating cable arranged in a tortuous configuration between a pair of supporting sheets.

Further objects and advantages of the instant invention will become obvious to one skilled in the art as the following description proceeds, and the features of novelty which characterize the invention will be pointed out in the claims annexed to and forming a part of the specification.

Figure 1:
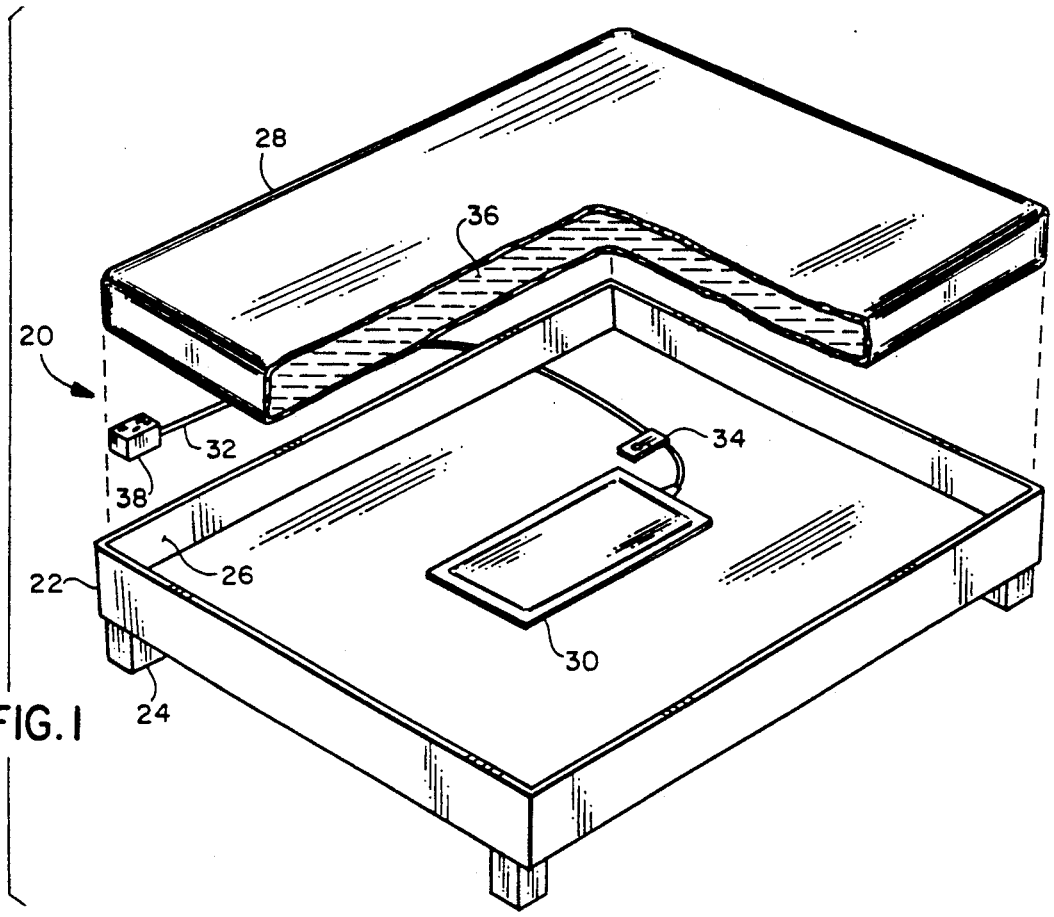
FIG. 1 is a exploded perspective view of a typical water bed showing the location of the heater comprising my invention associated with the water bed.

Turning to the drawings, there is shown in FIG. 1 a water bed 20 of the type in which the water bed heater forming my invention would typically be employed. The water bed 20 includes an open topped box-like supporting frame 22 having legs or supporting pedestal 24 and providing an upwardly facing cavity 26 within which a water bed mattress 28 would be located and supported. The water bed 20 might also include a liner to protect against water leakage from the mattress. However, whether the water bed heater is positioned directly beneath the mattress or beneath the liner adjacent the mattress is of no consequence insofar as the instant invention is concerned. The water bed 20 is provided with a heater 30 which is the subject of the instant invention. Connected to the heater 30 is a power cord 32 having a plug to connect the heater 30 to a utility line outlet. In circuit with the cord 32 and the heater 30 is a thermostatic control 34 which is positioned at a location spaced from the heater 30 but also located beneath the mattress 28 so that it will respond to the temperature of a volume of water 36 contained within the mattress 28.

Figure 2:
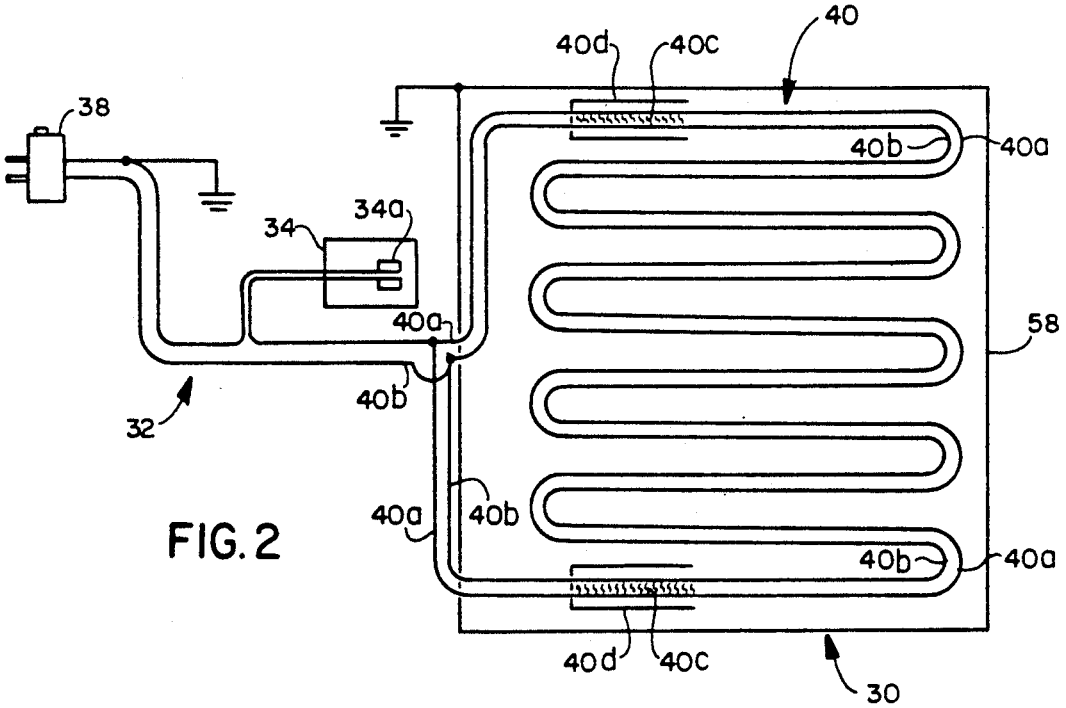
FIG. 2 is a schematic diagram showing my water bed heater in circuit with the power cord and temperature control thermostat.

Referring now to the schematic diagram of FIG. 2, we note that the power cord 32 is formed with a three prong grounded plug 38 that is shown connected in circuit with the thermostatic control 34. The thermostatic control 34 is conventional, including switch contacts 34*a* which are typically operated by some bimetalic means to open the switch contacts 34*a* when the temperature of the water 36 within the mattress 28 has reached the desired temperature, which is typically about 85° Fahrenheit. The water bed heater 30 is shown schematically in FIG. 2 and will now be described below in detail as to how it is constructed and assembled.

Figure 5:
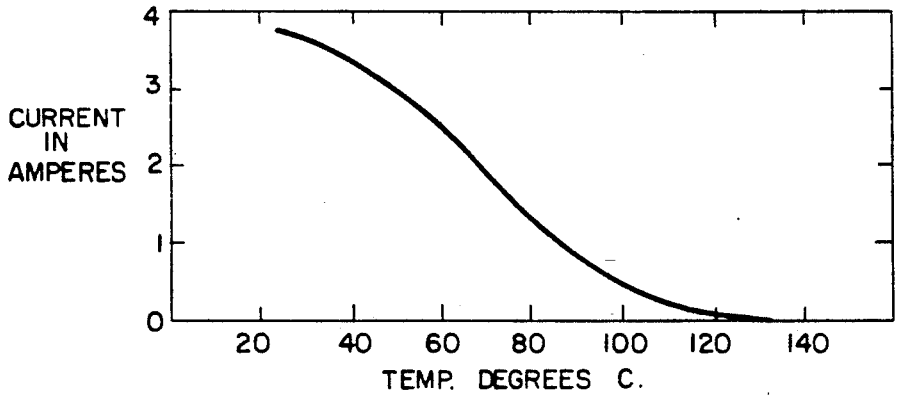
FIG. 5 is a graph showing the current plotted versus temperature for the PTC heating cable forming a part of the present invention.

The heater 30 comprises an elongated heating cable 40 which includes a pair of spaced conductors 40*a* and 40*b* which are separated by a layer of conductive polymer material 40*c*. The conductors 40*a* and 40*b* may be fabricated and designed in accordance with the teachings of Crowley Pat. No. 4,309,596 which is assigned to the same assignee as the instant application. The material 40*c* is preferably a carbon loaded polymer made in accordance with the teachings of Kelly Pat. No. 4,277,673 and exhibiting positive temperature coefficient resistance characteristics. That is, as the current passes between the conductors 40*a* and 40*b* through the resistive material 40*c*, the increasing temperature of the material 40*c* causes the resistance to rise which in turn reduces the current flow. The material, therefore, is described as being a self-limiting heater material. As shown in the graph of FIG. 5, a typical elongated piece of the cable 40 having a length of about 140 feet would have a wattage of about 350 watts and at room temperature would draw slightly less than 4 amps. This data for the graph of FIG. 5 is taken in a test setup in which the cable 40 is placed in an oven in which it is heated at the same time the current is measured at selected temperatures, as shown on the graph. To provide consistent data and eliminate the heating effect of the power applied to the cable 40, the current reading is taken five seconds after power application at each temperature. This delay also eliminates the current in-rush effects which are known to those skilled in the art of PTC materials.

As the temperature rises the resistance of the material 40*c* increases until at a temperature of 130° Centigrade the current flow is reduced substantially to zero. The cutoff temperature indicated by the graph is somewhat misleading since under normal conditions the heat conduction away from the cable would tend to limit the temperature to much lower levels. In ambient air at about 72° F., the cable 40 made in accordance with the present invention, would stabilize in temperature at about 180° F. (82° C.) when energized by a 120 volt power source. Thus, the heating cable is self-limiting so that in the event of any malfunction of the thermostatic control 34 there would be no possibility of the heater cable 40 increasing in temperature to a point where any breakdown in the adjacent element or material would occur.

It should be understood that the self-limiting characteristic of the wire functions essentially independently along each incremental length of the cable 40. The cable 40 is designed to reduce the wattage to each specific segment where overheating is occurring while normal wattage may be generated elsewhere down the length of the cable. In effect, each segment of wire is its own temperature sensor, assuring that every point on the cable 40 will have rapid and effective temperature control.

Figure 4:
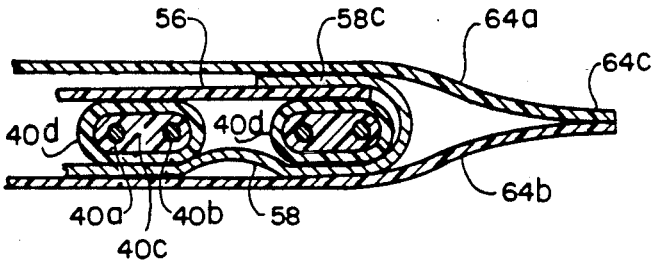
FIG. 4 is an enlarged fragmentary perspective view taken on line 4—4 of FIG. 3.
Figure 6:
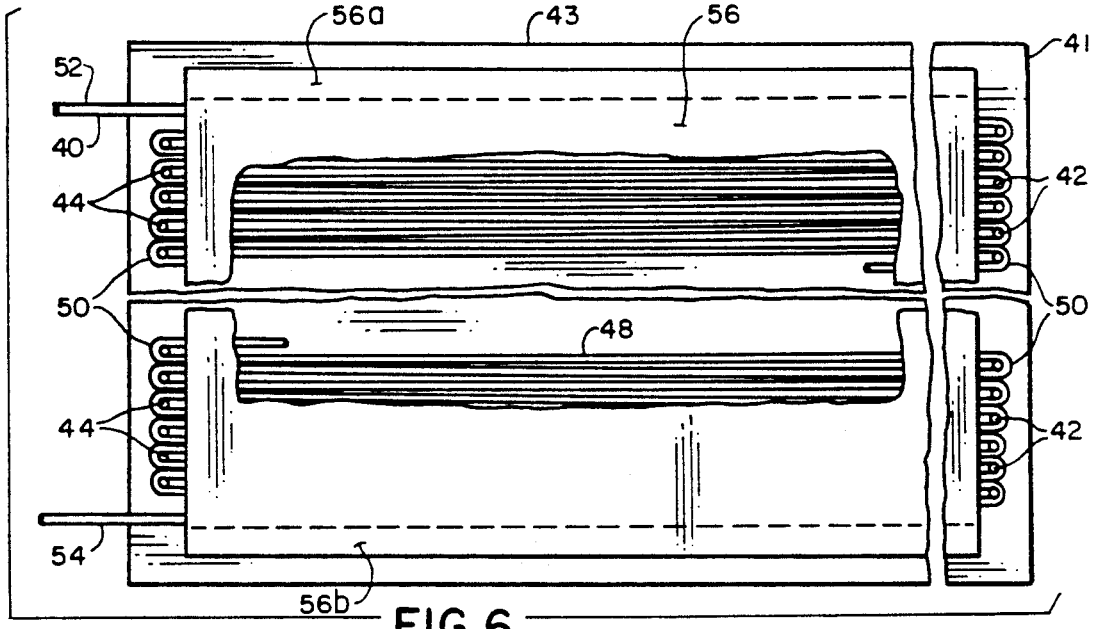
FIG. 6 is a top plan view of the water bed heater of FIG. 3 in a partially assembled form with a portion cut away for illustrative purposes.
Figure 7:
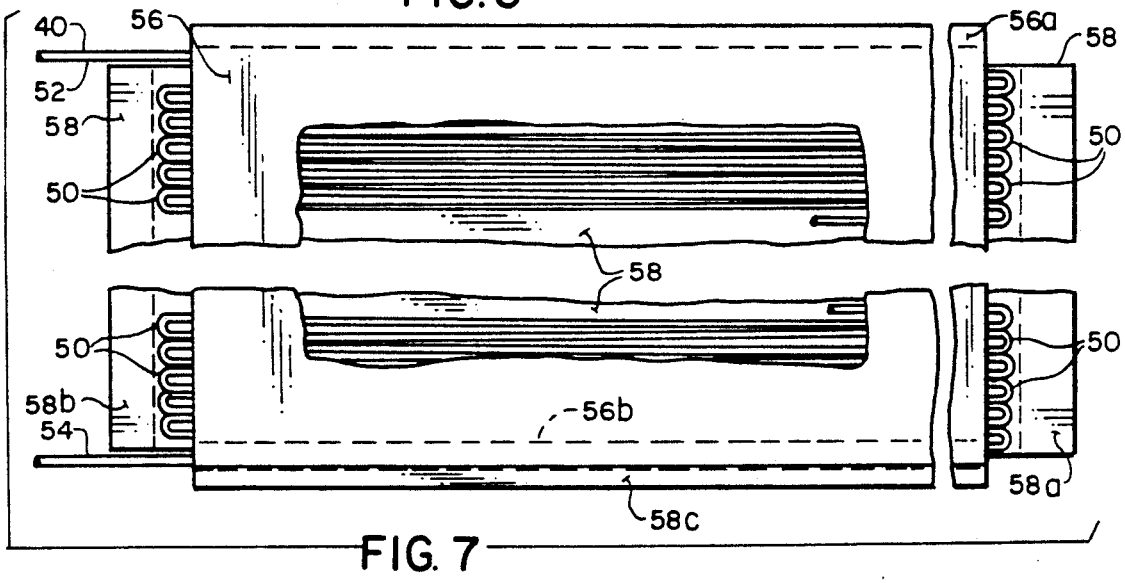
FIG. 7 is another top plan view of a portion of the water bed heater of FIG. 3 at another stage of the assembly process with portions cut away for illustrative purposes.

The heater cable 40 is preferably formed in an extrusion process in which the PTC material 40*c* completely envelopes the conductors 40*a* and 40*b*. An insulating sheath 40*d* is then extruded over the exterior of the PTC material 40*c*. The cable 40 in the preferred embodiment has a wattage of about two and one-half watts per running foot of the cable. In order to optimize the heat transfer from the length of heater cable 40 to the water bed mattress 28 it is desirable to configure the cable in a compact flat arrangement so that it may be readily positioned between the support frame 22 and the bottom of the mattress 28 as shown in FIG. 1. To accomplish this arrangement of the cable 40 it is initially wound on a fixture 41 comprising a rectangular table 43 having a flat surface from which there extends a plurality of mounting pins 42 at one end and a corresponding row of mounting pins 44 at the other end as shown in FIG. 6. The fixture pins 42 and 44 extend normal to and about half an inch above the table 43 against which the heater cable 40 will be positioned as it is wound around the pins 42 and 44 as shown in FIG. 6. The pins are approximately a eighth of an inch in diameter, the cable is in the preferred embodiment about an eighth of an inch in the long direction as shown in FIG. 4, and about a sixteenth of an inch in thickness or across the short dimension as shown in FIG. 4. The pins 42 and 44 are located on half inch centers. The heater cable 40 is wrapped back and forth from one pin 42 to the opposite pin 44 and back to the pin 42. In a preferred embodiment of the invention, there were forty-six parallel spaced legs designated by reference numeral 48, the lengths 48 being approximately three feet long and interconnected by the end turns 50 which extend around pins 42,44. The surface area of the heater, when complete as viewed in FIG. 9, was 15"×36".

Figure 8:
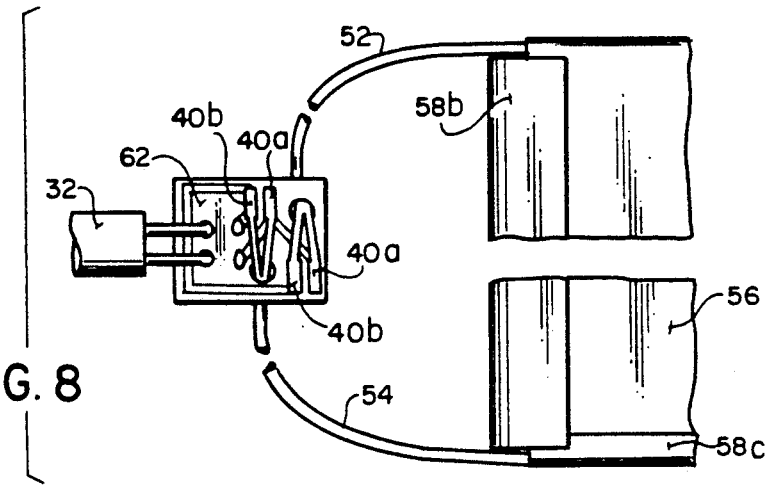
FIG. 8 is a showing of the electrical connections between the power cord and the PTC cable utilized in the water bed heater of FIG. 3.

The cable 40 is further provided with terminal ends 52 and 54 shown in FIG. 8 which extend away from the tortuous configuration of the cable as mounted on the pins 42 and 44.

Figure 10:
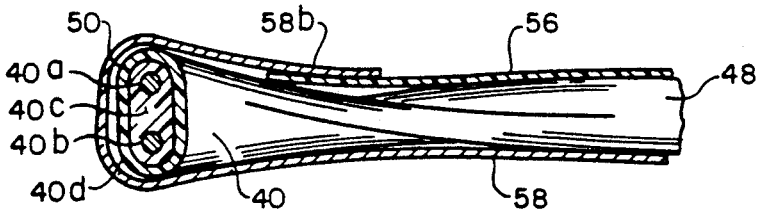
FIG. 10 is an enlarged fragmentary sectional view taken line 10—10 of FIG. 9.
Figure 11:
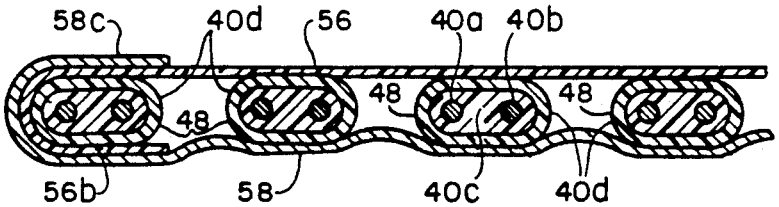
FIG. 11 is an enlarged fragmentary sectional view taken on line 11—11 of FIG. 9.
Figure 12:
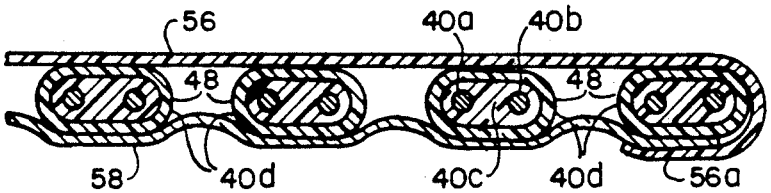
FIG. 12 is an enlarged fragmentary sectional view taken on line 12—12 of FIG. 9.

Once the heater cable 40 has been wrapped around the pins 42,44 as described, a piece of adhesively coated polyester sheet 56 is laid across the parallel legs 48 in between the pins 42 and 44 as shown in FIG. 6. The polyester sheet 56 is sold under the trademark Mylar and is precoated with an acrylic adhesive. A portion of sheet 56 has been cut away in FIG. 6 to show the parallel legs 48 of the heater cable 40. The polyester sheet 56 is preferably 0.002 inches, or 2 mil polyester sheet with the acrylic adhesive on the side facing the cable 40. Such adhesive coated Mylar material is available through Adhesive's Research, Inc. of Glen Rock, Pa. and is identified as DEV-7647. As the Mylar sheet 56 is applied to the upper surface of the cable 40 as mounted on the pins 42 and 44, it is pressed downwardly, thus causing the legs 48 of the cable 40 to rotate flat with the smaller dimensions perpendicular to the Mylar sheet 56 as illustrated by FIGS. 11 and 12 which show the completed assembly. It is noted, as shown in FIG. 10, that the end turn 50 of the heater cable 40 are on edge, so to speak, by virtue of having extended around the pins 42 and 44.

After the adhesive coated Mylar sheet 56 has been firmly engaged against the cable 40, as shown in FIG. 6, the assembly is removed from fixture 41 and the pins 42 and 44 and laid on a second sheet 58 which is formed of an aluminum material 0.0015 inches thick, or 1½ mils, the sheet aluminum also being precoated with an acrylic adhesive. Alternatively, the second sheet may be made of a Mylar and aluminum laminate including a 2 mil layer of Mylar and a 1½ mil layer of aluminum. The layer of Mylar associated with the aluminum is useful in maintaining the integrity of the sheet 58 against tearing, although it is less desirable from a cost and heat transfer standpoint. The Mylar/aluminum laminate coated with acrylic adhesive is available through Adhesive's Research, Inc. of Glen Rock, Pa. and designated as DEV-7422. The aluminum sheet 58 is formed with marginal ends 58*a* and 58*b* which extend beyond the end turns 50 of the cable 40. It is also noted that the Mylar sheet 56 has marginal side edges 56*a* and 56*b* which extend beyond the outermost of the legs 48 of the cable 40.

The aluminum sheet 58 is also provided with marginal side edge 58*c*. Prior to assembling the sheet 56 and the associated cable 40 to the polyester sheet 58 the edge 56*b* of the sheet 56 is folded around the outermost leg 48 as is shown in FIG. 11. Upon assembly to the sheet 58 the marginal ends 58*a* and 58*b* are folded over as indicated in FIG. 10 with respect to end 58*b* and the side edge 58*c* also folded over as shown in FIG. 11. In addition, the remaining edge 56*a* is folded under into engagement with the sheet 58, as shown in FIG. 12.

The sheets 56 and 58 serve the dual purpose of maintaining the overall flat coplanar distribution of the cable 40 and maintaining the parallel legs 48 with the wider dimensions parallel to the underside of the water bed mattress, thereby enhancing the heat transfer from the cable 40 to the mattress. The Mylar polyester sheet 56 provides a rigidity to the heater assembly so that it does not tend to fold or wrinkle. At the same time, the aluminum sheet 58 is less resilient and more ductile, tending to conform to the configuration of the heater cable 40 and hold the legs 48 in position better than if the assembly were made with two polyester sheets in a sandwich. The stiffness of the polyester tends to cause it to separate from the cable 40 if flexed even though the adhesive would otherwise maintain the position of the cable. It is further noted that the one and one-half mil aluminum and two mil Mylar polyester seem to provide the optimum characteristics for the heater sandwich. The one and one-half mil aluminum provides a firmness, while the polyester resists folding or wrinkling of the assembly. As mentioned above, the aluminum sheet 58 may be replaced by a laminate of 2 mil polyester and 1½ mil aluminum to lessen the chance of the aluminum sheet being torn or ruptured. Sheets of polyester from one to three mils are acceptable in performing the above described functions, as are aluminum sheets from one to 2 mils. As is evident from the schematic circuit diagram of FIG. 2, it is contemplated that the aluminum sheet 58 would be grounded to reduce hazards that might result from a shorting of one of the conductors 40*a* or 40*b*.

Figure 9:
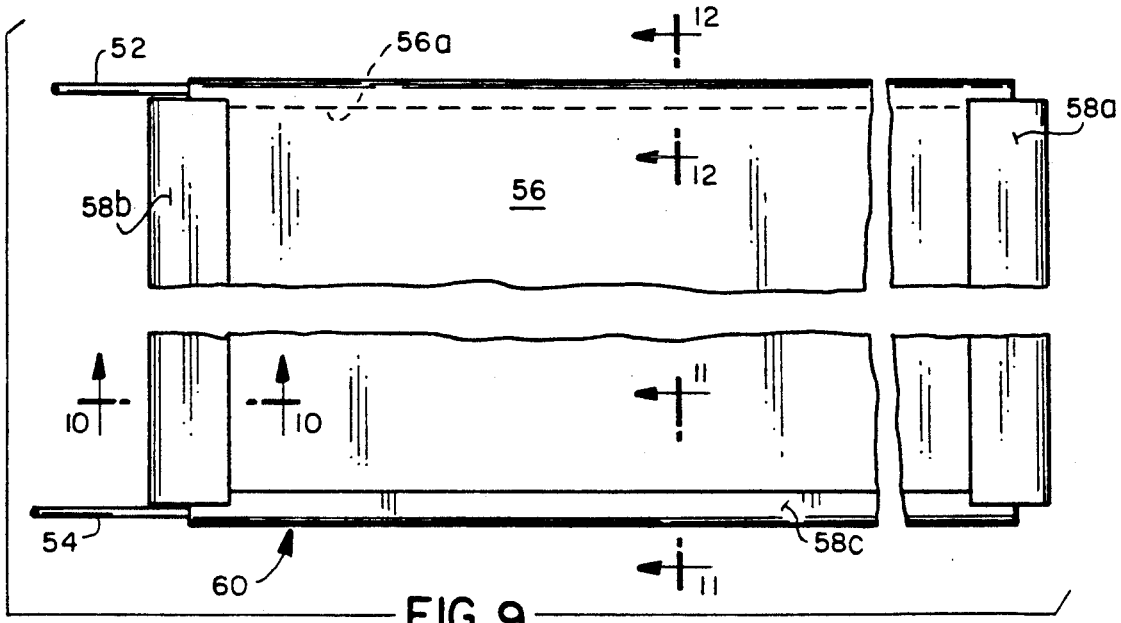
FIG. 9 is a top plan view of the water bed heater of FIG. 3 without the water sealing envelope, but otherwise, complete.

The assembly shown in FIG. 9 is designated as the sandwich assembly 60 including the heater cable 40 as disposed in its tortuous configuration and enclosed between the polyester sheet 56 and the aluminum sheet 58 and having the outwardly extending ends 52 and 54. Referring to FIG. 8, we note that the ends 52 and 54 of the cable 40 are connected at a circuit board 62 to the power cord 32. It should be noted that the opposite ends of each of the conductors 40*b* and 40*a* are connected to each other. That is, the conductor 40*a* forms one loop connected to one side of the power line and the conductor 40*b* forms another loop connected the other side of the power line. This end-to-end interconnection of the conductors tends to reduce the voltage drop over the length of the conductors 40*a* and 40*b* providing a relatively uniform voltage drop between the conductors 40*a* and 40*b*, reducing the tendency for the wattage generated in one end of the conductor 40 from being any greater than the wattage generated in the other end of the conductor 40.

Figure 3:
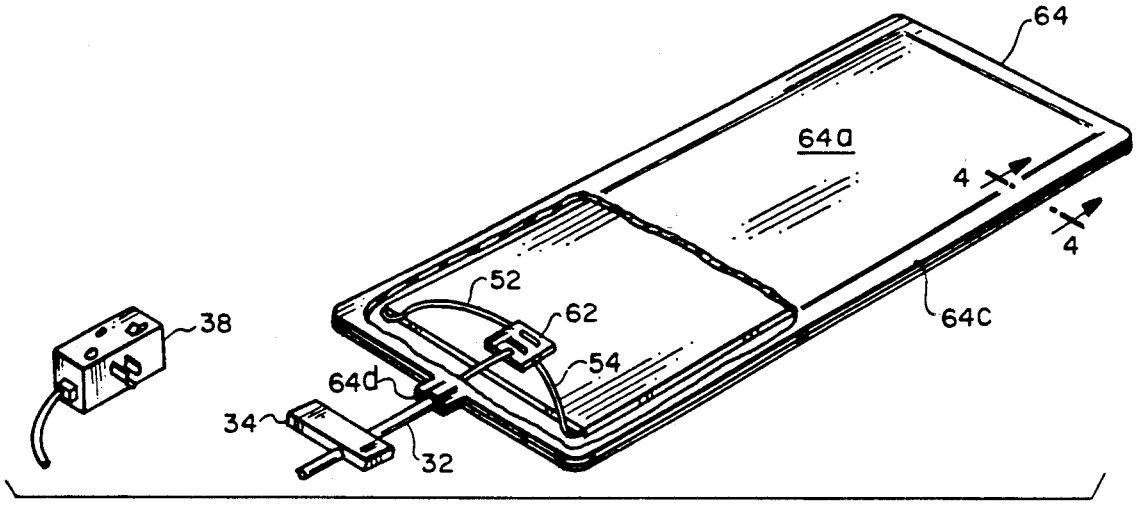
FIG. 3 is a perspective view of a preferred embodiment of a water bed heater embodying my invention showing a portion of the water sealing envelope cut away.

After the sandwich assembly 60 has been connected through the circuit board 62 to the power cord 32 and the thermostatic control 34, the sandwich assembly is inserted into a watertight envelope 64 as best shown in FIGS. 3 and 4. The envelope 64 is formed of two layers 64*a* and 64*b* of polyvinyl chloride heat sealed along its marginal edges at 64*c* to form a flat, rectangular enclosure within which the sandwich assembly 60 is positioned. The power cord 32 is provided with an outer insulation layer of PVC material, making it possible to seal the envelope 64 to the cord 32. For this purpose, there is provided an elongated throat (FIG. 3) which is heat sealed directly to the PVC power cord 32, thereby providing a water sealed envelope within which the sandwich assembly 60 is located. Prior to heat sealing, the assembly is evacuated of air to improve the heat transfer and eliminate the insulating effect that any entrained air might have. The complete water bed heater is positioned beneath the mattress 28 with the aluminum sheet 58 facing upwards to improve the heat transfer between the cable 40 and the mattress 28.

The PVC material forming the envelope 64 is preferably 0.030 inches, or 30 mils, in thickness, but it has been found that material from 10 to 40 mils is acceptable, and even up to 100 mils material would perform satisfactorily. However, the thicker material is unnecessarily costly. The preferred PVC material is rated for 105° Centigrade, but it has been found that 60° Centigrade PVC will perform in an acceptable manner. Under optimum conditions, it has been found that the surface of the cable 40 will be on the order of 130° to 140° Fahrenheit when the heater is operating. One of the advantageous characteristics of the PTC material 40*c* is that the wattage is high during the initial period when the temperature of the adjacent mass of water is the coolest. The wattage tends to be reduced as the temperature increases.

The foregoing provides a simple, effective and safe heater for a water bed. The interface conductivity problems associated with many of the prior art sheet type PTC heaters are completely eliminated in the present design. The encapsulation of the heater in its primary insulating envelope 60 and in the PVC envelope 64 along with the grounded aluminum sheet 56 provides the ultimate in safety and hazard elimination.

The self-limiting temperature characteristics of the cable 40 completely eliminates the need for safety thermostats associated with the heater and eliminates the risks of malfunction that such safety thermostats present. In addition, the cancelling effect of the electromagnetic fields produced by adjacent conductors effectively eliminates any possible health hazards from such fields.

What is claimed as new and desired to be secured by Letters Patent of the United States is:

1. A water bed heater for heating the liquid contained in a water bed mattress comprising an elongated length of cable which includes spaced wire conductors separated by a continuous layer of heater material comprising a positive temperature coefficient material, said heater material and conductors being surrounded by electrically insulating material, a power supply cord having two insulated leads for connection at one end to a household power outlet and connected at the other end to said wire conductors, the opposite ends of each conductor being connected together to form a loop, each loop being connected to a different one of said power cord insulated leads, said heater cable delivers between about 2 and 4 watts per foot with 120 volts power supply and said positive temperature coefficient material self-limits the surface temperature of said cable to less than about 65° Centigrade, said length of cable being disposed in a tortuous configuration having coplanar parallel closely spaced legs with the opposite ends of each leg connected to the adjacent end of a different immediately adjacent leg, said tortuously configured cable being enclosed by a supporting sandwich formed by two flexible sheets on opposite sides of said cable, each of said sheets being adhesively coated on the side facing said cable to secure said cable to said sheets and to maintain said cable in said tortuous configuration, said cable and said sheets forming a flat assembly which is resistant to wrinkling or flexure and a watertight envelope of PVC material enclosing said flat assembly, and is insertable beneath the mattress of a water bed in good heat transfer relation thereto for heating the liquid contents of said mattress, and said power supply cord extending from said assembly inside said envelope to a control thermostat outside of said envelope, said power supply cord having an outer PVC insulation, said envelope being heat sealed to said power supply cord insulation to maintain said envelope sealed against the entrance of water.

2. The water bed heater of claim 1 wherein said positive temperature coefficient material is formulated to have substantially infinite resistance at about 140° Centigrade, said heater cable in said sandwich in a water bed having a surface operating temperature of less than about 60° Centigrade.

3. The combination of claim 2 wherein one of said sheets is formed of polyester between about 0.005 and 0.002 inches in thickness and the other of said sheets is formed on aluminum between about 0.001 and 0.002 inches in thickness.

4. The combination of claim 3 wherein said aluminum sheet is electrically grounded to one side of the power supply cord and a thermostatic switch connected in said power supply cord and responsive to the temperature of the liquid in said mattress to control the power to said cable to maintain said liquid at approximately 85° Fahrenheit.

5. The water bed heater of claim 1 including one of said sheets having a metallic electrically conducting material.

6. The water bed heater of claim 5 wherein said one of said sheets is a laminate of aluminum and polyester.

* * * * *